US011183049B1

(12) United States Patent
Harish et al.

(10) Patent No.: US 11,183,049 B1
(45) Date of Patent: Nov. 23, 2021

(54) MONITORING AND INSTIGATING SHIFTS IN VISUAL FOCUS

(71) Applicant: International Business Machines Corporation, Armonk, NY (US)

(72) Inventors: Vignesh Harish, Cary, NC (US); Aaron T. Smith, Raleigh, NC (US); Tibor Beres, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 17/155,363

(22) Filed: Jan. 22, 2021

(51) Int. Cl.
*G08B 21/18* (2006.01)
*G08B 7/06* (2006.01)

(52) U.S. Cl.
CPC ..... *G08B 21/182* (2013.01); *G08B 7/06* (2013.01)

(58) Field of Classification Search
CPC ..... G08B 21/182; G08B 7/06
See application file for complete search history.

(56) References Cited

U.S. PATENT DOCUMENTS

| | | | | |
|---|---|---|---|---|
| 9,817,235 | B2 | 11/2017 | Errui | |
| 2015/0002676 | A1 | 1/2015 | Daewon | |
| 2015/0341616 | A1* | 11/2015 | Siegel | H04N 13/261 348/54 |
| 2016/0050391 | A1* | 2/2016 | Schultz | H04N 7/144 348/14.07 |
| 2017/0068313 | A1 | 3/2017 | Lin | |
| 2017/0242479 | A1* | 8/2017 | Moravetz | G02B 27/017 |
| 2019/0287028 | A1* | 9/2019 | St Amant | H04L 67/22 |
| 2019/0314149 | A1* | 10/2019 | Hyde | A61B 5/1107 |
| 2019/0328508 | A1* | 10/2019 | Hyde | A61F 2/1627 |
| 2020/0133453 | A1 | 4/2020 | Walker | |
| 2020/0237219 | A1 | 7/2020 | Roger | |

FOREIGN PATENT DOCUMENTS

| | | | |
|---|---|---|---|
| CN | 103927350 | A | 7/2014 |
| CN | 106372610 | B | 2/2020 |
| CN | 110838222 | A | 2/2020 |
| WO | 2017111104 | A1 | 6/2017 |

OTHER PUBLICATIONS

"The Free Break Reminder For Computer Eye Strain & CVS", Eye Breaks, 3 pages, downloaded from the Internet on Oct. 16, 2020, <http://www.eyebreaks.com/>.

Mell et al., "The NIST Definition of Cloud Computing", Recommendations of the National Institute of Standards and Technology, Special Publication 800-145, Sep. 2011, 7 pages.

* cited by examiner

*Primary Examiner* — Ojiako K Nwugo
(74) *Attorney, Agent, or Firm* — David K. Mattheis; Maeve M. Carpenter

(57) ABSTRACT

Monitoring and instigating shifts in visual focus by monitoring a first duration associated with a first focus point distance, determining that the first focus point distance satisfies a first distance threshold and that the first duration satisfies a first temporal threshold, instigating a change in the first focus point distance, yielding a second focus point distance, wherein the second focus point distance exceeds a second distance threshold, monitoring a second duration associated with the second focus point distance, determining that the second duration satisfies a second temporal threshold, and providing an output indicating satisfaction of the second distance threshold and second temporal threshold.

20 Claims, 5 Drawing Sheets

200

MONITORING AND INSTIGATING SHIFTS IN VISUAL FOCUS

BACKGROUND

The disclosure relates generally to the monitoring of visual focus and the instigation of periodic changes in focus depth. The disclosure relates particularly to monitoring visual focus over time and prompting periodic time and distance-based changes in focus depth.

Smart wearable devices enable sensing environmental aspects around a user of such devices. Devices provide data relating the relative positions of users and objects close to and distant from the user. The devices may be configured to capture data associated with the relative location of a user and an object being viewed by the user.

SUMMARY

The following presents a summary to provide a basic understanding of one or more embodiments of the disclosure. This summary is not intended to identify key or critical elements or delineate any scope of the particular embodiments or any scope of the claims. Its sole purpose is to present concepts in a simplified form as a prelude to the more detailed description that is presented later. In one or more embodiments described herein, devices, systems, computer-implemented methods, apparatuses and/or computer program products enable the monitoring and periodic shifting of visual focus.

Aspects of the invention disclose methods, systems and computer readable media associated with monitoring and instigating shifts in visual focus by monitoring a first duration associated with a first focus point distance, determining that the first focus point distance satisfies a first distance threshold and that the first duration satisfies a first temporal threshold, instigating a change in the first focus point distance, yielding a second focus point distance, wherein the second focus point distance exceeds a second distance threshold, monitoring a second duration associated with the second focus point distance, determining that the second duration satisfies a second temporal threshold, and providing an output indicating satisfaction of the second distance threshold and second temporal threshold.

BRIEF DESCRIPTION OF THE DRAWINGS

Through the more detailed description of some embodiments of the present disclosure in the accompanying drawings, the above and other objects, features and advantages of the present disclosure will become more apparent, wherein the same reference generally refers to the same components in the embodiments of the present disclosure.

DETAILED DESCRIPTION

Figure 1:
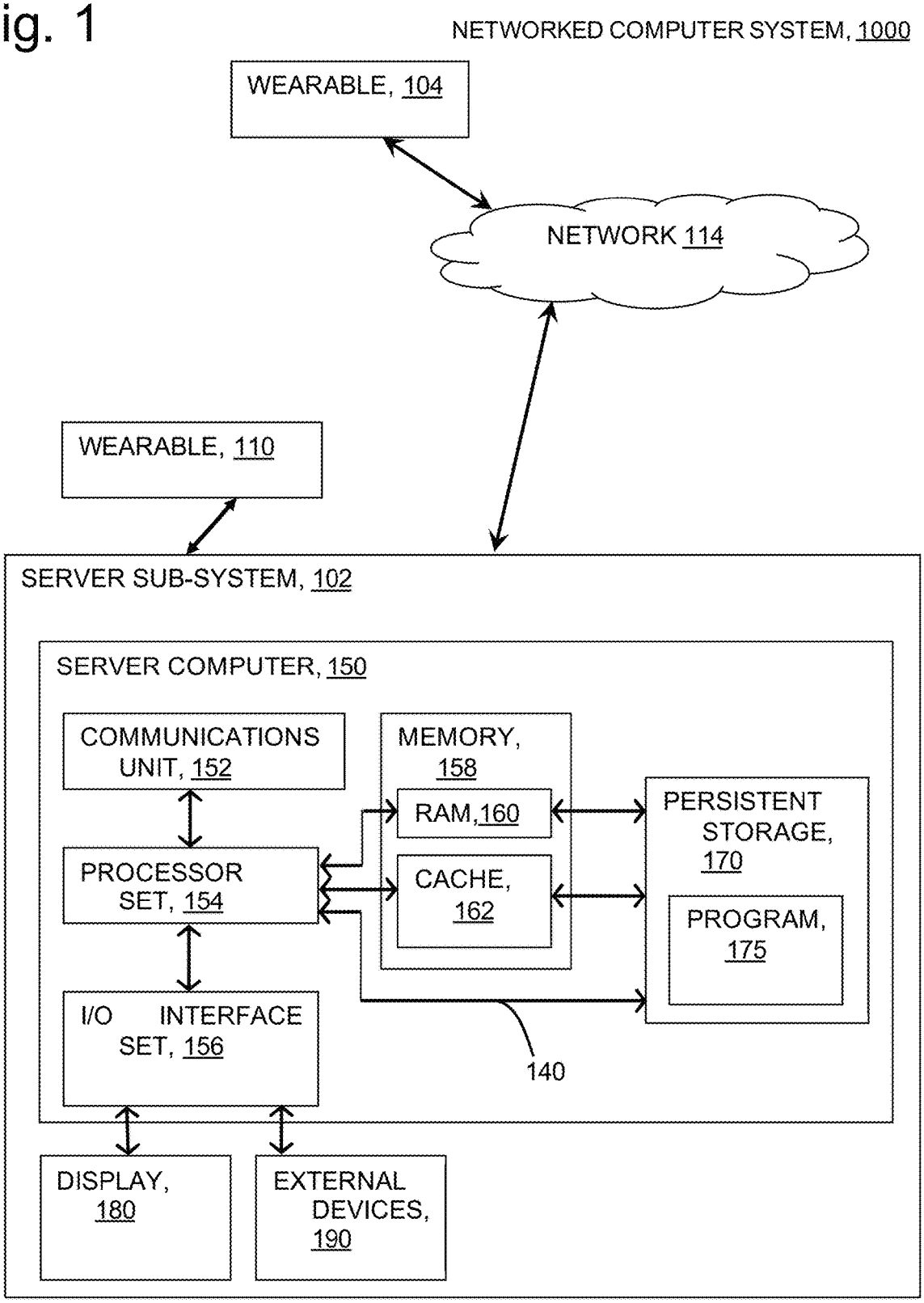
FIG. 1 provides a schematic illustration of a computing environment, according to an embodiment of the invention.

Some embodiments will be described in more detail with reference to the accompanying drawings, in which the embodiments of the present disclosure have been illustrated. However, the present disclosure can be implemented in various manners, and thus should not be construed to be limited to the embodiments disclosed herein.

Research suggests that focusing on nearby objects such as computer, tablet, smart phone, or a book for an extended period of time may lead to eye strain. Eye strain may negatively impact eye health as well as vision. One suggestion to alleviate eye strain and the accompanying issues recommends following a 20-20-20 rule. The 20-20-20 rules provides that after focusing on a nearby object for at least 20 minutes, an individual should look away and focus upon an object at least 20 feet away for at least 20 seconds.

Most individuals do not track the time spent focusing upon a nearby object, or the actual distance to the objects focused upon. Disclosed embodiments enable automatic tracking of the distance to objects and the time spent focusing upon those objects. Disclosed embodiments provide timely prompts to a user to shift their focus from nearby objects to a more distant object, and to maintain their focus upon the more distant object for sufficient time to relax the user's eyes. For example, disclosed embodiments track a user's focus and after 20 minutes of constant focus upon objects less than 20 feet away, the embodiments prompt the user to shift their focus to objects at least 20 feet away and to maintain their focus upon such distant objects for at least 20 seconds.

In an embodiment, one or more components of the system can employ hardware and/or software to solve problems that are highly technical in nature (e.g., monitoring a first duration associated with a first focus point distance, determining that the first focus point distance satisfies a first distance threshold and that the first duration satisfies a first temporal threshold, instigating a change in the first focus point distance, yielding a second focus point distance, wherein the second focus point distance exceeds a second distance threshold, monitoring a second duration associated with the second focus point distance, determining that the second duration satisfies a second temporal threshold, providing an output indicating satisfaction of the second distance threshold and second temporal threshold, etc.). These solutions are not abstract and cannot be performed as a set of mental acts by a human due to the processing capabilities needed to facilitate periodic changes in focus distance, for example. Further, some of the processes performed may be performed by a specialized computer for carrying out defined tasks related to monitoring and prompting changes in focus distance. For example, a specialized computer can be employed to carry out tasks related to monitoring user visual focus and prompting periodic shifts in focus distance or the like.

In an embodiment, a system of one or more devices provides the sensing and computing environment for disclosed methods. Sensing devices include one or more ultrasonic or infra-red (IR), or visual camera, distance sensors. The sensors are configured and disposed to detect objects in front of a user and within the field of view of the user. Smart wearable devices including smart glasses, smart earrings, smart contact lenses, or other smart wearable devices. The smart wearable device including the distance sensor may act independently or may be connected using a wired or wireless communications link and associated communications protocol such as WIFI, BLUETOOTH, BLUETOOTH LE, or other communications protocol. The smart wearable device may connect to another device such as a computer, a tablet device, a smart television, or a smart phone device. One or more aspects of the disclosed embodiments may be performed by the connected device such as the computer, etc. (Note: the term(s) "WIFI", "BLUETOOTH", and "BLUETOOTH LE", may be subject to trademark rights in various jurisdictions throughout the world and are used here only in reference to the products or services properly denominated by the marks to the extent that such trademark rights may exist.)

In this embodiment, the method receives data from the distance sensor. The data provides an indication of the distance from the user to the objects in front of the user. In an embodiment, the configuration of the device and sensor provides an indication of the distance between the user and an object inferred to be in the center of the user's field of view. For example, the distance sensor may be configured at an angle relative to the user such that the sensor determines the distance to a point at the user's eye level. In an embodiment, utilizing smart glasses or smart contact lenses, the method receives data directly indicating the current visual focus of the user as well as data indicating the distance to that object. As a user shifts their focus from one object to another, the data associated with the object of focus and the distance to the object changes reflecting the changes due to the shift in focus.

The method tracks the time spent focused upon objects in terms of the distance to the objects and a first focus threshold. For example, the method initiates a timer after receiving focus distance data indicating focus upon an object closer to a user than a defined first distance threshold and continues to allow the timer to accumulate as long as the focus distance data received indicates an object distance less than the first threshold distance, e.g., twenty feet. The method monitors the accumulated time compared to a defined first temporal threshold such as twenty minutes, or another defined temporal limit. As time accumulates, the method monitors the focus distance data. The method resets the time upon receipt of focus distance data indicating a user's focus has shifted to an object further away than the defined first distance threshold. For example, the method starts a timer after receiving focus distance data indicating focus upon an object about twenty inches from the user, less than a defined threshold of twenty feet. The timer accumulates until the method receives new focus distance data indicating a focus shift to an object about twenty-five feet away—exceeding the defined twenty-foot distance threshold. The method resets the timer after receiving this distance data.

As another example, the method receives data indicating a focus distance less than the defined first distance threshold and starts a timer. The method monitors received distance data until reaching a first temporal threshold without receiving distance data exceeding the first distance threshold. After reaching the first temporal threshold, the method instigates a shift in the user's focus distance from a distance less than the first distance threshold to a focus distance greater than a second distance threshold. In an embodiment, the first and second distance thresholds are the same distance, e.g., twenty feet. Alternatively, the first and second distance threshold are different distances, e.g., the first threshold is ten feet and the second threshold is twenty feet.

In instigating the shift in the user's focus distance, the method provides a user prompt. The method prompts the user by way of an audible prompt, a visual prompt, a haptic prompt, or a combination of these prompts. Audible prompts include a system default tone, or a tone selected by the user, or provided by the user for use as the prompt. In an embodiment, the user records an audio message for use as the prompt. Visual prompts include indicia displayed using the smart glasses or smart contact lenses or visual display elements, e.g., light emitting diodes, of smart earrings or other wearable devices. In an embodiment, the method displays a relevant prompting indicium upon the display of a linked smart phone, smart television, or computer system. In an embodiment, the method utilizes a haptic prompt causing the smart wearable device or linked device to vibrate to attract the attention of the user. In an embodiment, the method utilizes a combination of two or more of the audible, visual and haptic prompts, such as generating a tone and causing a device to vibrate, to attract the attention of the user. The audible and visual prompts may further include instructions to the user such as an audible, or visible message instructing the user to look away from the current object of their focus.

After providing the user prompt, the method and system monitor the focus distance data until receiving data indicating a new focus distance exceeding the second distance threshold. The system and method provide a second prompt to the user indicating that the user's focus has shifted to an appropriately distanced object. The method starts a second timer tracking the time spent at the focus exceeding the second distance threshold.

The system and method monitor the progression of the second timer and concurrently monitor the focus distance sensor data. For instances where the user's focus distance data indicates that the user's focus exceeds the second distance threshold for a duration greater than a second temporal threshold, such as about twenty seconds, the method provides a prompt to the user indicating that the focus shift need has been met and that the user may return to a task involving a focus distance less than the first distance threshold. For instances where the user's focus distance data indicates that the user's focus has shifted to an object at a distance less than the second focus distance, the method resets the second timer to zero and again monitors focus distance data from the sensor for data indicating a focus distance exceeding the second distance threshold. After receiving focus distance data indicating a distance exceeding the second distance threshold, the method restarts the second timer. Focus distance data indicating a shift in focus to another object also exceeding the second distance threshold does not lead to a reset of the second timer. In such an instance, the second duration timer continues to accumulate time toward satisfying the second temporal threshold.

FIG. 1 provides a schematic illustration of exemplary network resources associated with practicing the disclosed inventions. The inventions may be practiced in the processors of any of the disclosed elements which process an instruction stream. As shown in the figure, a networked Smart wearable device 110 connects wirelessly to server sub-system 102. Smart wearable device 104 connects wirelessly to server sub-system 102 via network 114. Smart wearable devices 104 and 110 comprise application program (not shown) together with sufficient computing resource (processor, memory, network communications hardware) to execute the program. As shown in FIG. 1, server sub-system 102 comprises a server computer 150. FIG. 1 depicts a block diagram of components of server computer 150 within a networked computer system 1000, in accordance with an embodiment of the present invention. It should be appreciated that FIG. 1 provides only an illustration of one implementation and does not imply any limitations with regard to the environments in which different embodiments can be implemented. Many modifications to the depicted environment can be made.

Server computer 150 can include processor(s) 154, memory 158, persistent storage 170, communications unit 152, input/output (I/O) interface(s) 156 and communications fabric 140. Communications fabric 140 provides communications between cache 162, memory 158, persistent storage 170, communications unit 152, and input/output (I/O) interface(s) 156. Communications fabric 140 can be implemented with any architecture designed for passing data and/or control information between processors (such as microprocessors, communications and network processors, etc.), system memory, peripheral devices, and any other hardware components within a system. For example, communications fabric 140 can be implemented with one or more buses.

Memory 158 and persistent storage 170 are computer readable storage media. In this embodiment, memory 158 includes random access memory (RAM) 160. In general, memory 158 can include any suitable volatile or non-volatile computer readable storage media. Cache 162 is a fast memory that enhances the performance of processor(s) 154 by holding recently accessed data, and data near recently accessed data, from memory 158.

Program instructions and data used to practice embodiments of the present invention, e.g., the monitoring and focus shifting program 175, are stored in persistent storage 170 for execution and/or access by one or more of the respective processor(s) 154 of server computer 150 via cache 162. In this embodiment, persistent storage 170 includes a magnetic hard disk drive. Alternatively, or in addition to a magnetic hard disk drive, persistent storage 170 can include a solid-state hard drive, a semiconductor storage device, a read-only memory (ROM), an erasable programmable read-only memory (EPROM), a flash memory, or any other computer readable storage media that is capable of storing program instructions or digital information.

The media used by persistent storage 170 may also be removable. For example, a removable hard drive may be used for persistent storage 170. Other examples include optical and magnetic disks, thumb drives, and smart cards that are inserted into a drive for transfer onto another computer readable storage medium that is also part of persistent storage 170.

Communications unit 152, in these examples, provides for communications with other data processing systems or devices, including resources of smart wearable computing devices 104, and 110. In these examples, communications unit 152 includes one or more network interface cards. Communications unit 152 may provide communications through the use of either or both physical and wireless communications links. Software distribution programs, and other programs and data used for implementation of the present invention, may be downloaded to persistent storage 170 of server computer 150 through communications unit 152.

I/O interface(s) 156 allows for input and output of data with other devices that may be connected to server computer 150. For example, I/O interface(s) 156 may provide a connection to external device(s) 190 such as a keyboard, a keypad, a touch screen, a microphone, a digital camera, and/or some other suitable input device as well as output devices including an audio speaker. External device(s) 190 can also include portable computer readable storage media such as, for example, thumb drives, portable optical or magnetic disks, and memory cards. Software and data used to practice embodiments of the present invention, e.g., monitoring and focus shifting program 175 on server computer 150, can be stored on such portable computer readable storage media and can be loaded onto persistent storage 170 via I/O interface(s) 156. I/O interface(s) 156 also connect to a display 180.

Display 180 provides a mechanism to display data, including prompts, to a user and may be, for example, a computer monitor. Display 180 can also function as a touch screen, such as a display of a tablet computer.

Figure 2:
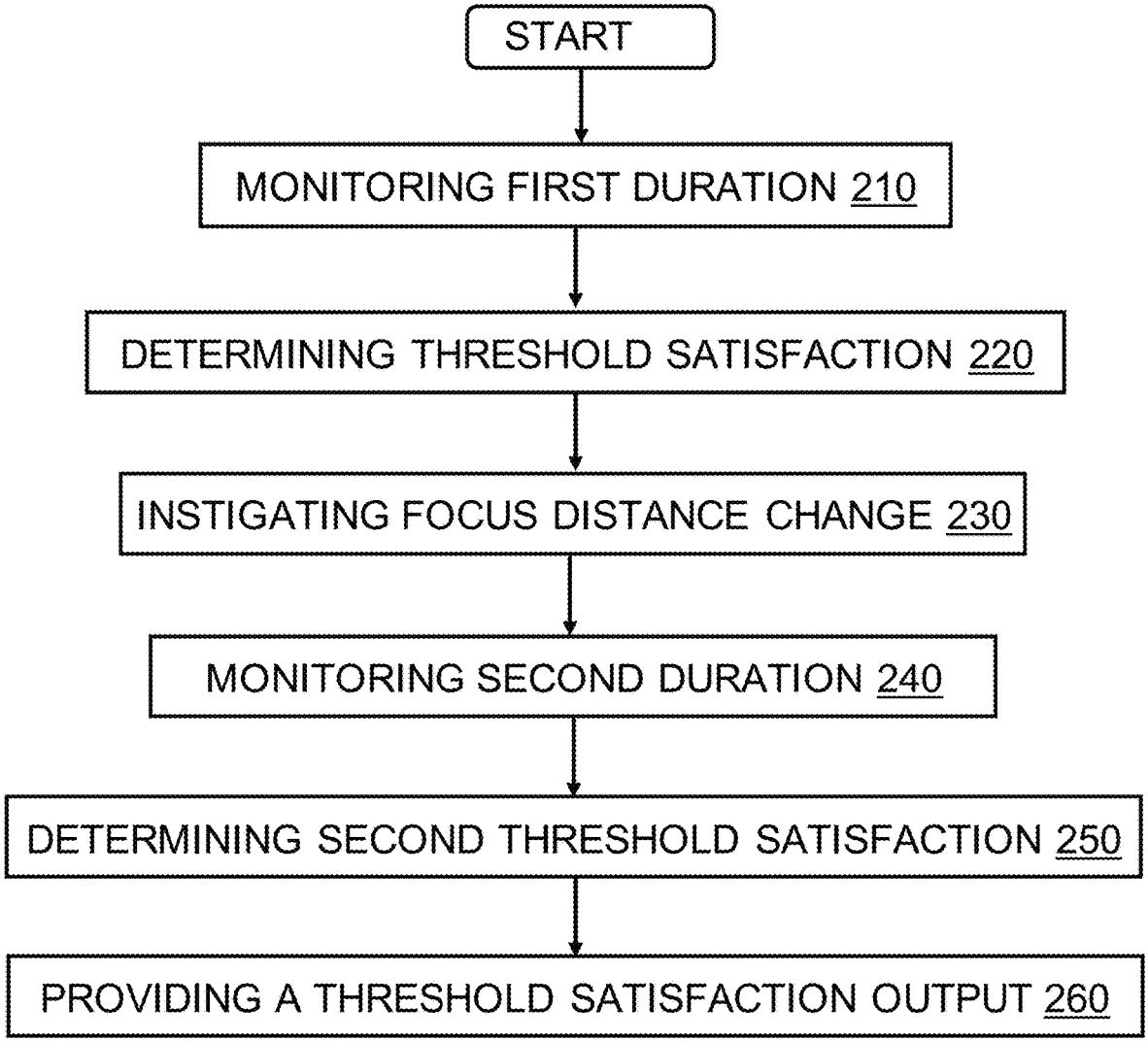
FIG. 2 provides a flowchart depicting an operational sequence, according to an embodiment of the invention.

FIG. 2 provides a flowchart 200, illustrating exemplary activities associated with the practice of the disclosure. After program start, at block 210 the method of monitoring and focus shifting program 175 monitors a first duration. The first duration relates to the accumulated duration of time during which sensor data indicates a user focus distance less than a first distance threshold, such as twenty feet. The duration resets anytime that the sensor data indicates a focus distance exceeding a second distance threshold.

At block 220, the method of monitoring and focus shifting program 175 determines that the first duration exceeds a first temporal threshold, indicating that the monitored sensor user focus distance data has indicated a focus distance less than the first distance threshold for at least as long as a defined first temporal threshold, such as twenty minutes.

At block 230, after the first distance and temporal thresholds are satisfied, the method of monitoring and focus shifting program 175 instigates a change in the user's focus distance from a distance less than the first threshold to a distance greater than a second threshold. In an embodiment, the first and second distance thresholds are the same distance. In an embodiment, the method prompts the user to change focus using an audible, visual haptic or combination prompt and further prompts the user when the shifted focus satisfies the second distance threshold using an addition audible, visual, haptic, or combination prompt.

At block 240, the method of monitoring and focus shifting program 175 monitors a second duration associated with maintaining the user's focus distance at a distance exceeding the second distance threshold. When sensor data indicates that the user's focus distance falls below the second distance threshold, the method resets the second duration count-up timer. Changes in the user's focus, as indicated by the sensor distance data, from one object further than the second distance threshold to a second object further than the second distance threshold do not trigger a rest of the second duration timer.

At block 250 the method of monitoring and focus shifting program 175 determines that a second temporal threshold has been satisfied by maintaining user focus distance on objects further away than the second distance threshold for a duration at least equaling the second temporal threshold.

At block 260 the method of monitoring and focus shifting program 175 provides an output to the user indicating satisfaction of the second duration and distance thresholds and signaling that the user may return to tasks having a user focus distance less than the first distance threshold.

Figure 3:
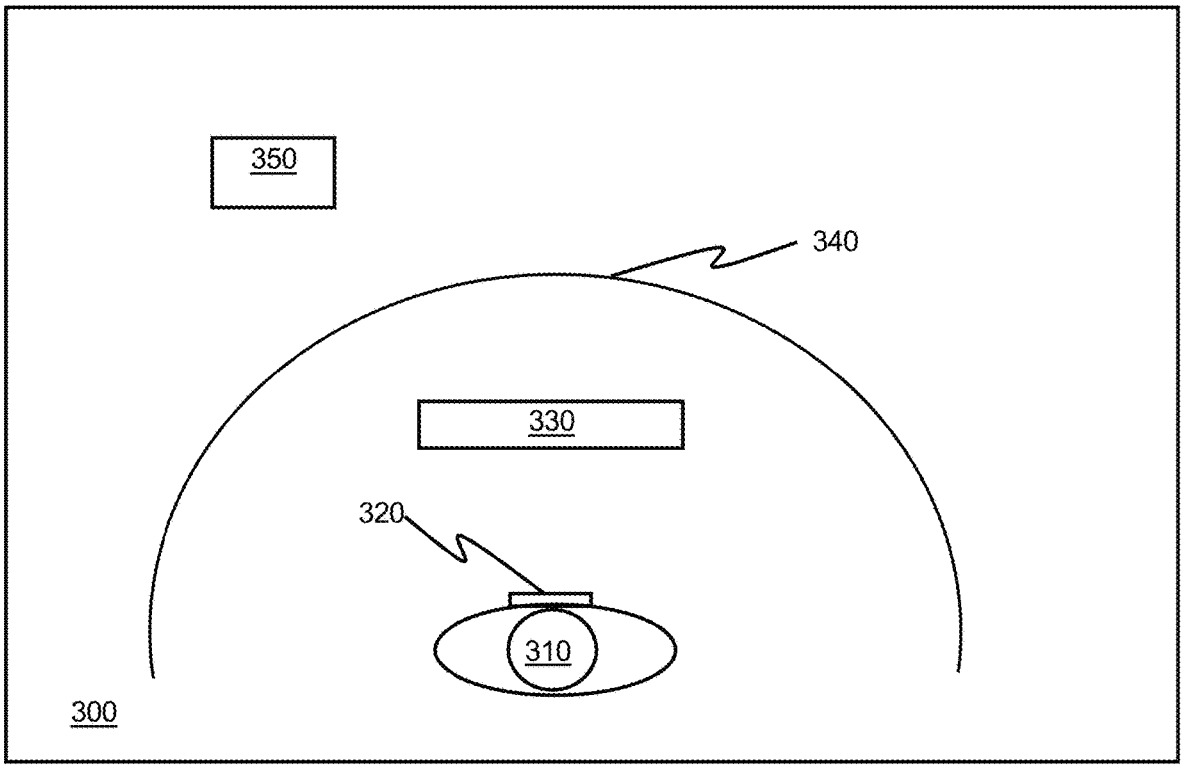
FIG. 3 provides a schematic view of a user's environment, according to an embodiment of the invention.

FIG. 3 provides a schematic illustration 300 of a user's environment, according to an embodiment of the invention. As shown in the Figure, user 310 employs wearable device 320 to monitor the user's focus within the environment. Wearable device 320 senses the user's focus and enables time-based monitoring of the user's focus distance as being either upon an object 330 at a distance less than a first distance threshold 340, or upon an object 350 at a distance exceeding the first distance threshold 340, e.g., twenty feet.

In an embodiment, the distance thresholds and temporal thresholds for on task and off-task are provided by a physician after an examination of the user to determine the optimal on-task and off-task duration ratio as well as the optimal distance thresholds according to the eye health and visual acuity of the user. As an example, after examination, a physician may indicate that the first and second distance thresholds should be fifteen feet according to the current visual acuity of the user and that the duration thresholds should be twenty minutes on-task and twenty second off-task.

It is to be understood that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported, providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Figure 4:
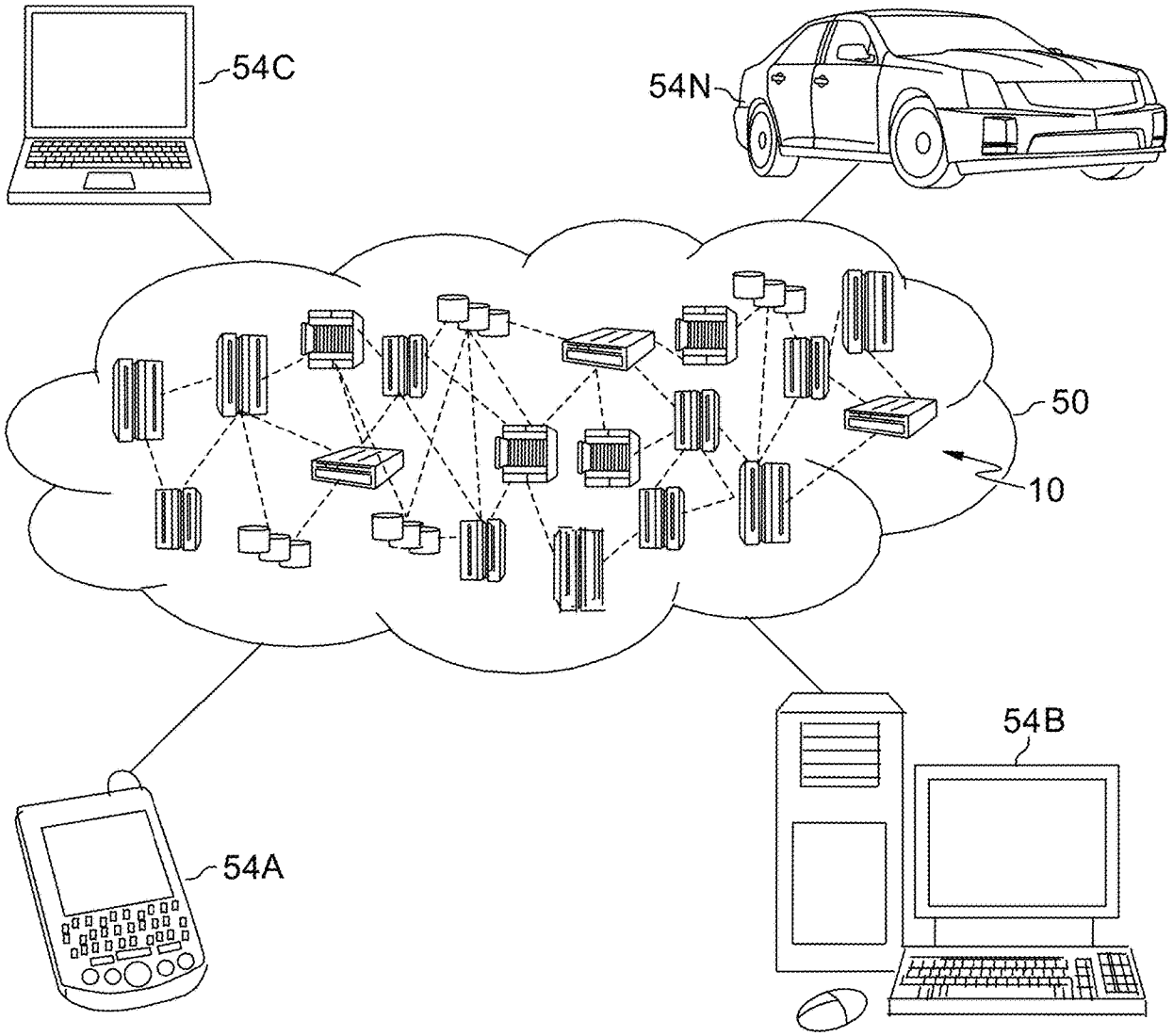
FIG. 4 depicts a cloud computing environment, according to an embodiment of the invention.

Referring now to FIG. 4, illustrative cloud computing environment 50 is depicted. As shown, cloud computing environment 50 includes one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 4 are intended to be illustrative only and that computing nodes 10 and cloud computing environment 50 can communicate with any type of computerized device over any type of network and/or network addressable connection (e.g., using a web browser).

Figure 5:
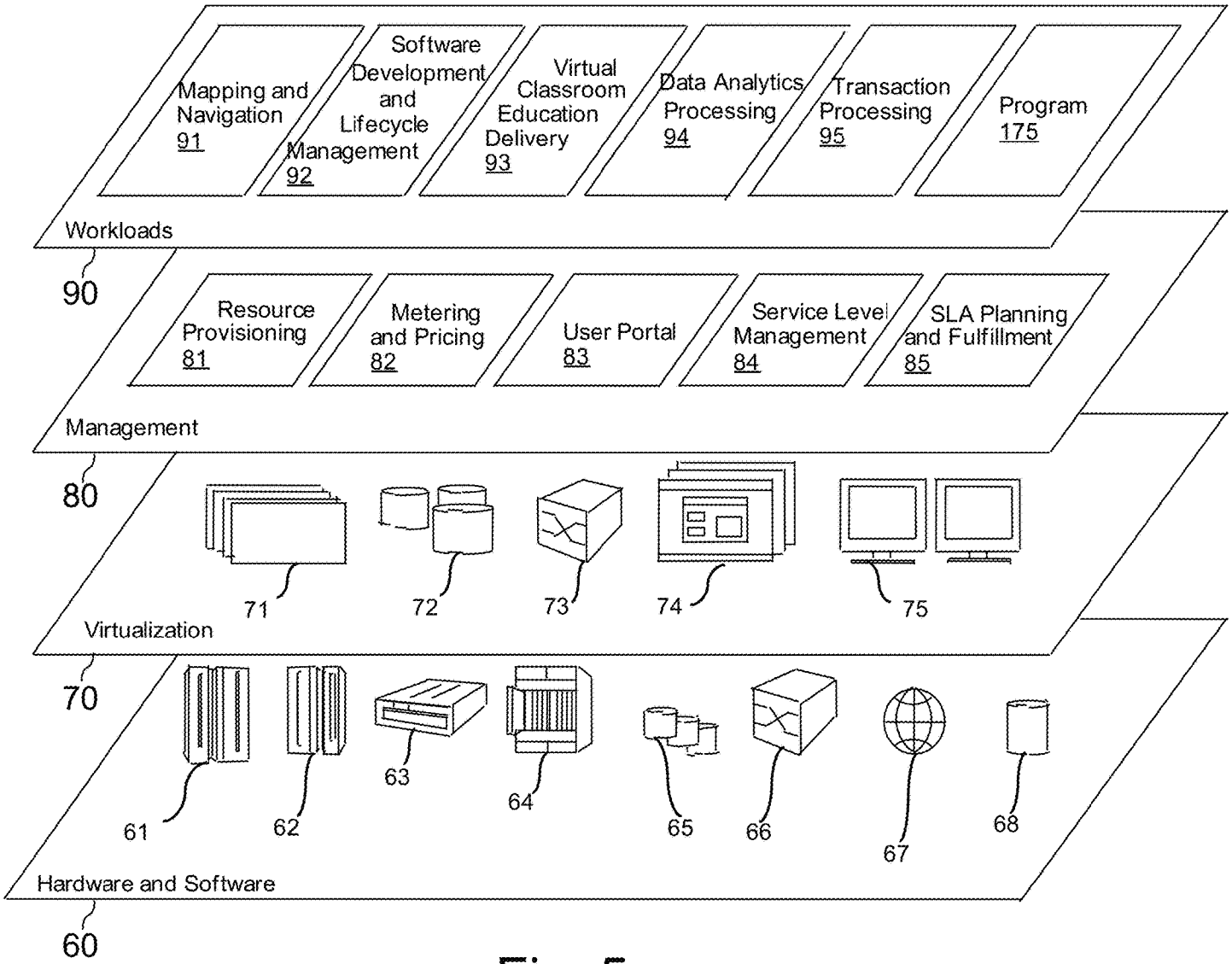
FIG. 5 depicts abstraction model layers, according to an embodiment of the invention.

Referring now to FIG. 5, a set of functional abstraction layers provided by cloud computing environment 50 (FIG. 4) is shown. It should be understood in advance that the components, layers, and functions shown in FIG. 5 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture-based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and monitoring and focus shifting program 175.

The present invention may be a system, a method, and/or a computer program product at any possible technical detail level of integration. The invention may be beneficially practiced in any system, single or parallel, which processes an instruction stream. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, or computer readable storage device, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/ or other devices to function in a particular manner, such that the computer readable storage medium having instructions collectively stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the invention. The terminology used herein was chosen to best explain the principles of the embodiment, the practical application or technical improvement over technologies found in the marketplace, or to enable others of ordinary skill in the art to understand the embodiments disclosed herein.

What is claimed is:

1. A computer implemented method, the method comprising:

monitoring, by one or more computer processors, a first duration associated with a first focus point distance;

determining, by the one or more computer processors, that the first focus point distance satisfies a first distance threshold and that the first duration satisfies a first temporal threshold;

instigating, by the one or more computer processors, a change in the first focus point distance, yielding a second focus point distance, wherein the second focus point distance exceeds a second distance threshold;

monitoring, by the one or more computer processors, a second duration associated with the second focus point distance;

determining, by the one or more computer processors, that the second duration satisfies a second temporal threshold; and providing, by the one or more computer processors, an output indicating satisfaction of the second distance threshold and second temporal threshold.

2. The computer implemented method according to claim 1, further comprising:

detecting, by the one or more computer processors, a change from the second focus point distance to a third focus point distance, wherein the third focus point distance is less than the second distance threshold; and resetting, by the one or more computer processors, the second duration.

3. The computer implemented method according to claim 1, further comprising:

detecting, by the one or more computer processors, a change during the first duration from the first focus point distance to a fourth focus point distance, wherein the fourth focus point distance exceeds the first distance threshold; and resetting, by the one or more computer processors, the first duration.

4. The computer implemented method according to claim 1, wherein the first distance threshold and the second distance threshold are equal.

5. The computer implemented method according to claim 1, wherein the first temporal threshold comprises about twenty minutes.

6. The computer implemented method according to claim 1, wherein the second temporal threshold comprises about twenty seconds.

7. The computer implemented method according to claim 1, wherein the output comprises a stimulus selected from the group consisting of audible, visual and haptic outputs.

8. A computer program product, the computer program product comprising one or more computer readable storage devices and collectively stored program instructions on the one or more computer readable storage devices, the stored program instructions comprising:

program instructions to monitor a first duration associated with a first focus point distance;

program instructions to determine that the first focus point distance satisfies a first distance threshold and that the first duration satisfies a first temporal threshold;

program instructions to instigate a change in the first focus point distance, yielding a second focus point distance, wherein the second focus point distance exceeds a second distance threshold;

program instructions to monitor a second duration associated with the second focus point distance;

program instructions to determine that the second duration satisfies a second temporal threshold; and program instructions to provide an output indicating satisfaction of the second distance threshold and second temporal threshold.

9. The computer program product according to claim 8, the stored program instructions further comprising:

program instructions to detect a change from the second focus point distance to a third focus point distance, wherein the third focus point distance is less than the second distance threshold; and program instructions to reset the second duration.

10. The computer program product according to claim 8, the stored program instructions further comprising:

program instructions to detect a change during the first duration from the first focus point distance to a fourth focus point distance, wherein the fourth focus point distance exceeds the first distance threshold; and program instructions to reset the first duration.

11. The computer program product according to claim 8, wherein the first distance threshold and the second distance threshold are equal.

12. The computer program product according to claim 8, wherein the first temporal threshold comprises about twenty minutes.

13. The computer program product according to claim 8, wherein the second temporal threshold comprises about twenty seconds.

14. The computer program product according to claim 8, wherein the output comprises a stimulus selected from the group consisting of audible, visual and haptic outputs.

15. A computer system for tensor comparison across a network, the computer system comprising:

one or more computer processors;

one or more computer readable storage devices; and stored program instructions on the one or more computer readable storage devices for execution by the one or more computer processors, the stored program instructions comprising:

program instructions to monitor a first duration associated with a first focus point distance;

program instructions to determine that the first focus point distance satisfies a first distance threshold and that the first duration satisfies a first temporal threshold;

program instructions to instigate a change in the first focus point distance, yielding a second focus point distance, wherein the second focus point distance exceeds a second distance threshold;

program instructions to monitor a second duration associated with the second focus point distance;

program instructions to determine that the second duration satisfies a second temporal threshold; and program instructions to provide an output indicating satisfaction of the second distance threshold and second temporal threshold.

16. The computer system according to claim 15, the stored program instructions further comprising:

program instructions to detect a change from the second focus point distance to a third focus point distance, wherein the third focus point distance is less than the second distance threshold; and program instructions to reset the second duration.

17. The computer system according to claim 15, the stored program instructions further comprising:

program instructions to detect a change during the first duration from the first focus point distance to a fourth focus point distance, wherein the fourth focus point distance exceeds the first distance threshold; and program instructions to reset the first duration.

18. The computer system according to claim 15, wherein the first distance threshold and the second distance threshold are equal.

19. The computer system according to claim 15, wherein the first temporal threshold comprises about twenty minutes.

20. The computer system according to claim 15, wherein the second temporal threshold comprises about twenty seconds.

* * * * *